US005266866A

United States Patent [19]

Takagi et al.

[11] Patent Number: 5,266,866

[45] Date of Patent: Nov. 30, 1993

[54] LOW PRESSURE GAS DISCHARGE LAMP

[75] Inventors: Masami Takagi, Yokohama; Hidehiko Noguchi, Imabari, both of Japan

[73] Assignee: Toshiba Lighting & Technology Corporation, Tokyo, Japan

[21] Appl. No.: 675,802

[22] Filed: Mar. 27, 1991

[30] Foreign Application Priority Data

Mar. 28, 1990 [JP] Japan ..... 2-79712

[51] Int. Cl.[5] ..... H01J 11/00

[52] U.S. Cl. ..... 313/607; 313/492; 313/493; 313/488; 313/634

[58] Field of Search ..... 313/607, 608, 492, 488, 313/234, 493, 634, 572

[56] References Cited

U.S. PATENT DOCUMENTS

| | | | |
|---|---|---|---|
| 1,612,387 | 12/1926 | Machlett | 313/607 |
| 2,068,741 | 1/1937 | Geffcken et al. | 313/607 |
| 4,147,951 | 4/1979 | Mueller . | |
| 4,645,979 | 2/1987 | Chow | 313/607 |
| 4,765,820 | 8/1988 | Naganawa et al. | 313/493 |
| 4,871,941 | 10/1989 | Dobashi et al. | 313/607 |
| 4,887,002 | 12/1989 | Dobashi et al. | 313/607 |
| 4,899,090 | 2/1990 | Yoshiike et al. | 313/572 |

FOREIGN PATENT DOCUMENTS

| | | |
|---|---|---|
| 0053281 | 6/1982 | European Pat. Off. . |
| 0394743 | 10/1990 | European Pat. Off. . |
| 57-63756 | 4/1982 | Japan . |
| 63-141256 | 6/1988 | Japan . |
| 63-146343 | 6/1988 | Japan . |

*Primary Examiner*—Donald J. Yusko
*Assistant Examiner*—Brian Zimmerman
*Attorney, Agent, or Firm*—Cushman, Darby & Cushman

[57] ABSTRACT

A low pressure gas discharge lamp comprises an elongated tube filled with a discharge gas. An inner electrode is disposed in a first end portion of the tube and an outer electrode is formed on an outer surface of the tube. The outer electrode has a belt shaped portion formed on the outer surface of the tube along an axial direction of the tube between the first end portion and a second end portion of the tube and a ring shaped portion formed on the outer surface of the tube around the second end portion of the tube. The ring shaped portion is connected to the belt shaped portion. The discharge is generated between the inner electrode and the outer electrode. The ring shaped portion of the outer electrode prevents the discharge from shifting from a central axis of the tube, and thus makes the lamp have an even brightness distribution along the axis of the tube.

17 Claims, 3 Drawing Sheets

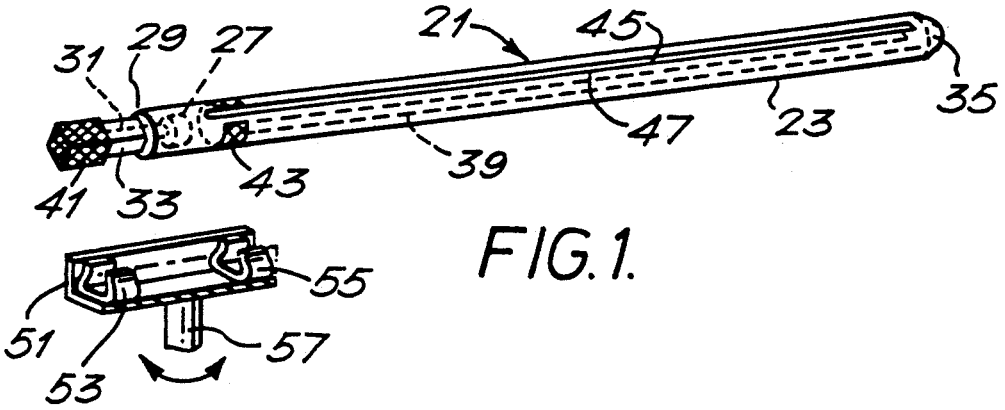
FIG. 1.
FIG. 2.
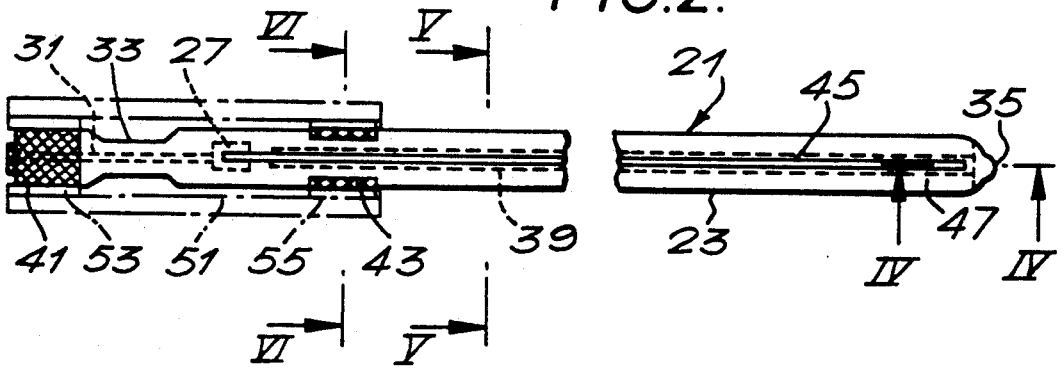
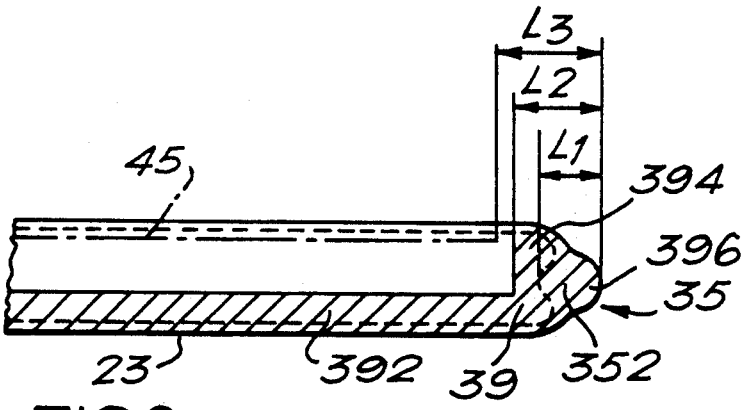
FIG. 3.
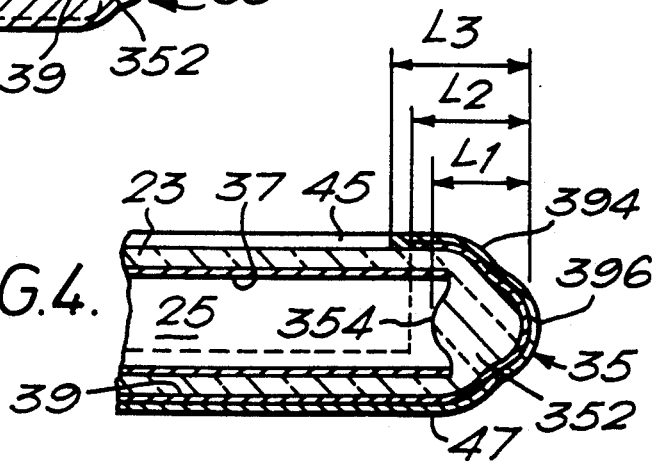
FIG. 4.

LOW PRESSURE GAS DISCHARGE LAMP

BACKGROUND OF THE INVENTION

1. Field of the Invention

The present invention relates to a low pressure gas discharge lamp having an inner electrode disposed in a tube and an outer electrode disposed on a surface of the tube.

2. Description of the Prior Art

In recent years, small gas discharge lamps have been used as parts of display devices.

More specifically, a light emitting tube composed of an extremely thin hollow glass tube is described in U.S. Pat. Nos. 4,645,979 and U.S. Pat. No. 4,871,941. A gas discharge lamp as described above has an inner electrode at one end of a rod shaped glass tube, which forms a slender discharge space, and a belt shaped outer electrode located along the axial direction of the outer surface of the tube. The lamp also has a phosphor layer which emits visible light coated on the inner surface of the tube. The phosphor is excited by U.V. radiation emitted from the filling gas, such as mercury vapor or xenon, due to a discharge generated between the inner electrode and the outer electrode. A lamp having a gas such as neon, which emitts visible light, is also described in the above publications.

However this lamp has an undesirable distribution of its brightness because the top portion of the tube, where the inner electrode is not provided, is darker than the other portions of the tube. The distribution of its brightness is improved by the art described in U.S. Pat. No. 4,887,002, but the brightness of the top portion of the tube is still lower than that of the other portions of the tube.

SUMMARY OF THE INVENTION

Accordingly, it is an object of the present invention to provide a low pressure gas discharge lamp having an improved and desirable distribution of its brightness.

In order to achieve the above mentioned object, the low pressure gas discharge lamp according to the present invention comprises:

an elongated hollow tube having inner and outer surfaces;

a filling gas contained in the tube for emitting radiation in response to a discharge;

an inner electrode disposed in a first end portion of the tube; and an outer electrode having a belt shaped portion formed on the outer surface of said tube along an axial direction between the first end portion and a second end portion of the tube and a ring shaped portion, connected to the belt shape portion, formed on the outer surface of the tube around the second end portion of the tube, whereby the discharge is generated between the inner electrode and the outer electrode.

BRIEF DESCRIPTION OF THE DRAWINGS

In the accompanying drawings:

FIG. 1 is a perspective view of a low pressure gas discharge lamp and a lamp holder according to a first embodiment of the present invention;

FIG. 2 is a plan view of FIG. 1;

FIG. 3 is a partial side view of FIG. 1 without a shielding film;

FIG. 4 is a partial sectional view taken along the line IV—IV of FIG. 2;

DETAILED DESCRIPTION OF THE PREFERRED EMBODIMENTS

Figure 5:
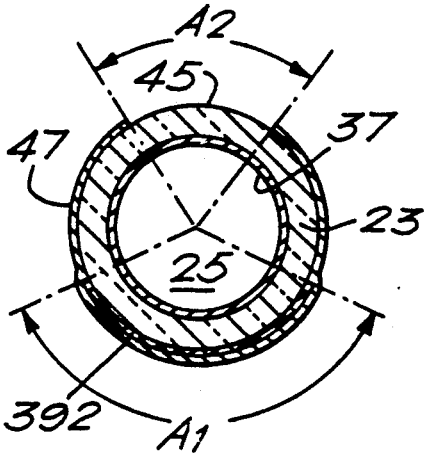
FIG. 5 is a sectional view taken along the line V—V of FIG. 2.

The present invention will now be described with respect to a first embodiment in which the present invention is a low pressure gas discharge lamp used as a display needle of an instrument.

In FIG. 1, a low pressure gas discharge lamp 21 used as a display needle comprises a hollow rod shaped glass tube 23 formed with a narrow discharge space 25 (shown in FIG. 4) therein. The glass tube 23 has, for example, an outer diameter of 2.5 mm, an inner diameter of 1.5 mm, a wall thickness of 0.5 mm, a total length of approx. 60 mm, and is formed in a needle shape.

An inner electrode 27 is airtightly attached to the first end portion 29 of the tube 23. The electrode 27 is a cold cathode type made from a hollow nickel tube having electron emitting material (not shown) therein and connected to a lead wire 31 hermetically passed through a pinch seal portion 33 of the first end portion 29. The lead wire 31 is made of a dumet wire having a diameter of 0.3 mm.

The second end portion (the top end portion) 35 of the tube 23 does not have an inner electrode. As shown in FIG. 3 and FIG. 4, the glass tube at the top end portion 35 is shaped as a lump (thick portion) 352 having a thickness L1 which is thicker than that at the other portions of the tube 23, and has a wall thickness of 0.5 mm. The glass tube at the top end portion 35 swells (extends) in both directions along the axis of tube 23, i.e., outside and inside of the tube 23, and forms a lump (thick portion) 352. Accordingly, the wall thickness of the lump (thick portion) 352 of the top end portion 35 is much more than that of other portions of the tube 23.

Since the lump (thick portion) 352 of the top end portion 35 is thicker than the other portions of the tube 23, the top end portion 35 remains sturdy against a shock caused by something hitting it.

After lamp 21 is evacuated with a vacuum, it is sealed at the top end portion 35 without any special exhaust tube. Therefore the lamp 21 and the discharge space 25 have almost even thickness from the first end portion 29 to the top end portion 35 and the thickness of the positive column of the discharge is even from the first end portion 29 to the top end portion 35. As the result, the lamp 21 does not have the drawback that its brightness near the top end portion 35 is lower than that at its other portions. The uneven brightness is caused by the positive column of the discharge becoming thinner near the top end portion 35.

As shown in FIG. 4, phosphor layer 37 is coated on an inner surface of the tube 23 and extends beyond the inner top 354 of the lump 352 to the top end portion 35. Because of this, near the top end portion 35 sufficient light is emitted. The phosphor layer 37 is coated before attaching the inner electrode 27, exhausting the tube 23 and sealing the top end portion 35.

Xenon gas is sealed between 5–40 Torr, or preferably between approx. 20–40 Torr, in the tube 23.

An outer electrode 39 having a belt shaped portion 392, a ring shaped portion 394 and a cap shaped portion 396 is located along the axial direction and outer surface of the tube 23, as is indicated by the hatching area in FIG. 3. The outer electrode 39 is made by coating in belt shape, ring shape and a cap shape, the predetermined portion of the tube 23 with paste such as carbon phenol or silver exoxy, baking it, and forming it in a film shape. The outer electrode 39 is formed from the area opposite to the inner electrode 27 to the top end portion 35 of the tube 23.

The belt shaped portion 392 of the outer electrode 39 has a width covering the center angle A1 of more than 120 degree, as shown in FIG. 5, along almost all of the length of the tube except for the top end portion 35 of the tube 23 and an area nearby. The cap shaped portion 396 and the ring shaped portion 394 cover the top end portion 35 and the area nearby, respectively. Both portions 394, 396 have a combined length L2 and extend beyond the inner top 354 of the lump (thick portion) 352 from the top end portion 35, as shown in FIG. 4. The length L2 is longer than the length L1 of the lump (thick portion) 352. It is important that the ring shape portion 394 of the outer electrode 39 covers the outer surface of the tube 23 in an area corresponding to the inner surface of the lump (thick portion) 352 in a ring shape. The inner surface of the lump (thick portion) 352 defines a boundary between a top portion of the discharge space 25 and the top end portion 35. The cap shaped portion 396 of the outer electrode 39 covering the top end portion 35 of the tube 23 is not always necessary.

A first receptacle terminal 41, shown in FIG. 1, is formed on the outer surface of the first end portion 29 and is connected electrically to the inner electrode 27 through the lead wire 31. The first receptacle terminal 41 is made by coating, in a cap shape, with paste such as carbon phenol or silver epoxy and baking it.

A second receptacle terminal 43 is isolated at a position with respect to the first receptacle terminal 41 and is connected to the outer electrode 39. The second receptacle terminal 43 is made by coating, in a semicircular shape, with paste such as carbon phenol or silver epoxy and baking it around the tube 23. Further, the second receptacle terminal 43 surrounds the tube 23 except for a light transmitting slit portion 45 of a shielding film 47.

The shielding film 47 formed on the outer surface of the tube 23 is composed of carbon, epoxy resin and adhesive. The shielding film 47 is formed to cover the outer electrode 39 on the surface of the tube 23, and the light transmitting slit portion 45, which is not covered by the shielding film 47, extends along the axial direction on the surface opposed to the surface formed with the belt shaped portion 392 of the outer electrode 39.

Moreover, the outer electrode 39 is formed, as shown in the sectional view of FIG. 5, on a partial outer surface of tube 23, and the light transmitting slit portion 45 is not covered by the shielding film 47 and is formed on the tube 23 opposite (by 180 degree) to the belt shaped portion 392 of the outer electrode 39. Accordingly, the light in the tube 23 is externally radiated only through the light transmitting slit portion 45. Thus the lamp 21 works as an aperture-type device. The angle A1 of the belt shaped portion 392 is wider than angle A2 of the light transmitting slit portion 45.

Figure 6:
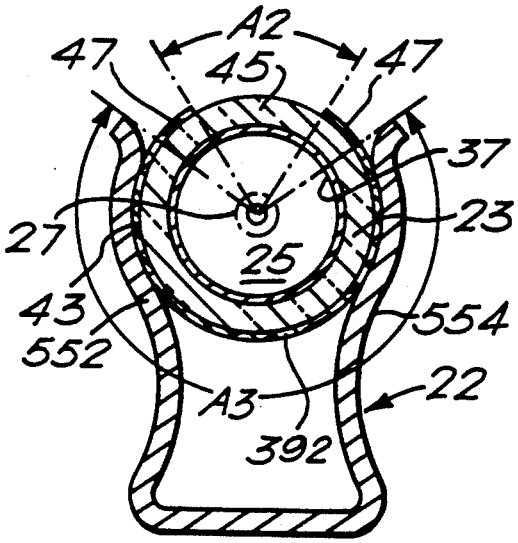
FIG. 6 is a sectional view taken along the line VI—VI of FIG. 2.

The shielding film 47 covers the entire surface of the tube 23 except for the first and second receptacle terminals 41 and 43 and the light transmitting slit portion 45, and the first and second receptacle terminals 41 and 43 are exposed directly to the outside of the lamp 21. FIG. 6 shows that the shielding film 47 does not cover the second receptacle terminals 43, and has the angle A3.

The shielding film 47 covers the area, having the length L3, of the outer surface of the lamp 21 around the top end portion 35 of the tube 23. The length L3 is longer than the total length L2 of the ring shaped portion 394 and the cap shaped portion 396 of the outer electrode 39. Thus the shielding film 47 perfectly covers the ring shaped portion 394 and the cap shaped portion 396 of the outer electrode 39 and also covers the lump (thick portion) 352.

The xenon discharge lamp 21 described above is attached to a lamp holder 51 shown in FIG. 1.

The lamp holder 51 has a U shape and is made of an electrically insulating material. First and second terminal pieces 53 and 55, respectively for supplying power to the lamp 21 are fixed in the lamp holder 51 so as to be isolated from each other. These terminal pieces 53 and 55 are formed by bending conductive leaf springs, made of phosphorus bronze, for example into a U shape, to hold the lamp 21 by means of holding sections 552 and 554 opposed to each other as shown in FIG. 6.

The lamp holder 51 is fixed to the rotational shaft 57 to be rotated for display of an instrument. When the rotational shaft 57 is rotated, the lamp holder 51 is correspondingly pivoted.

The rotational shaft 57 of this embodiment is composed of a hollow shaft, not shown. Two cords (not shown) are inserted into the hollow shaft 57. One end pair of the cords are connected to the first and second terminal pieces 53 and 55, and the other ends are connected to a high frequency power source.

The lamp 21 is attached at the end portion thereof to the lamp holder 51 so as to connect the inner electrode 27 and the outer electrode 39 with the power source through the first and second receptacle terminals 41 and 43 and the first and second terminal pieces 53 and 55. In other words, the first and second receptacle terminals 41 and 43 are formed on the outer surface of the tube 23 at positions corresponding respectively to the first and second terminal pieces 53, 55. When the lamp 21 is pushed into the lamp holder 51 from the open side of the lamp holder 51, the holding sections 552 and 554 of the second terminal piece 55 hold the second receptacle terminal 43, and in the same way the holding sections of the first terminal piece 53 hold the first receptacle terminal 41. According to this, the lamp is held mechanically in the lamp holder 51 and is connected electrically to the power source.

A discharge is generated between the inner and outer electrodes 27 and 39 of the tube 23 by supplying high frequency power to the inner and outer electrodes 27 and 39 through the first and second receptacle terminals 41 and 43.

This discharge excites xenon gas sealed in the spectrum peculiar to the xenon gas. This short wavelength ray excites the phosphor film 37, emitting visible light from the phosphor film 37.

The visible light generated from the phosphor film 37 is radiated externally from the slit portion 45. Thus, since the slit portion 45 is formed in a narrow strip shape, in addition to the fact that the tube 23 is narrow, the lamp 21 is adapted to indicate the display scale as a display needle.

Since the lamp holder 51 is fixed to the rotational shaft 57 and the lamp holder 51 is correspondingly pivoted when the rotational shaft 57 is rotated, the lamp 21 attached to the lamp holder 51 is correspondingly moved to indicate the display scale.

In the embodiment described above, the ring shaped portion 394 of the outer electrode 39 covers the outer surface of the tube 23 corresponding to the inner surface of the lump (thick portion) 352 in a ring shape. Because of this, the positive column of the discharge of the lamp 21 is kept at the central axis of the tube 23 near the top end portion 35 and is prevented from shifting to the direction of the outer electrode 39 near the top end portion 35 of the tube 23. Since the current density in the lamp 21 near the top end portion is smaller than in the other portion of the tube 23, the positive column generated between the inner electrode 27 and the outer electrode 39 is likely to shift from the center of the tube 23 to the direction of the outer electrode 39 near the top end portion. However the outer electrode 39 near the top end portion is formed in the ring shape. Therefore, the positive column of the discharge of the lamp 21 is kept at the centeral axis of the tube 23 near the top end portion 35. Accordingly, the decreasing of the brightness of the lamp 21 near the top end portion 35 is eliminated and sufficient light is emitted near the top end portion 35 of the lamp 21.

Figure 7:
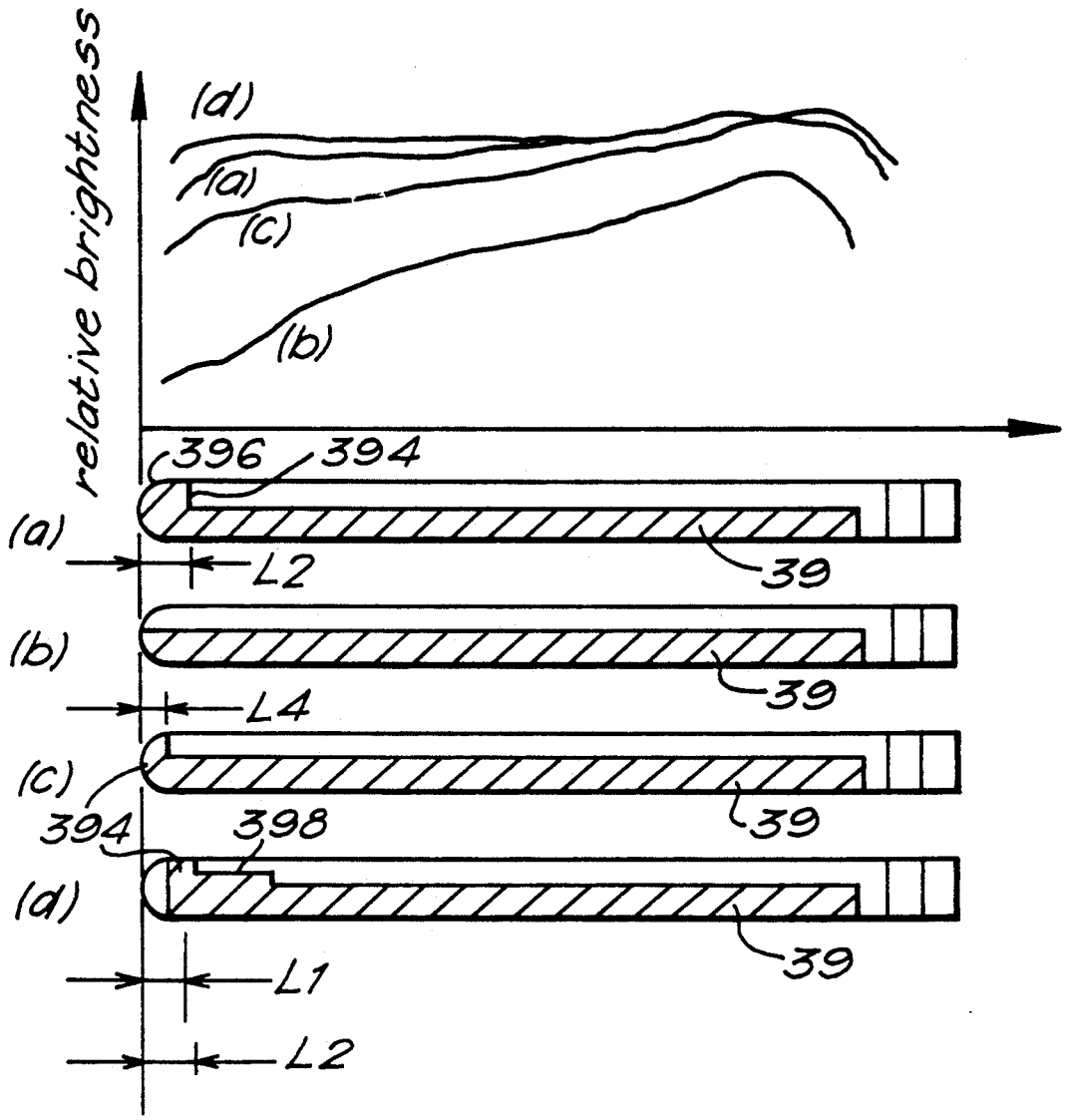
FIG. 7 illustrates the brightness distribution characteristic diagram of the lamps of the invention.

FIG. 7 indicates brightness distribution characteristic diagrams of four lamps. In FIG. 7, line (a) indicates the brightness distribution characteristic diagram of the lamp of the first embodiment above described. The line (a) and the lamp (a) correspond to each other. The feature of the outer electrode of the lamp (a) is shown in FIG. 7. In the same way, the line (b), the line (c) and the line (d) indicate the brightness distribution characteristics diagrams of the lamp (b), the lamp (c) and the lamp (d) respectively. The feature of the outer electrode of each lamp is shown in FIG. 7. The lamp (b) and the lamp (c) are experimental models made during the development of the invention and are compared with lamp (a) of the first embodiment. The outer electrode of the lamp (b) has the same width along the axis of the lamp and does not have a ring shaped portion at the top end portion. The outer electrode of the lamp (c) has a belt shaped portion along the axis of the lamp and a ring shaped portion and a cap shaped portion at the top end portion of the lamp. However the total length L4 of the ring shaped portion and the cap shaped portion of the outer electrode is shorter than the length L1 of the lamp (thick portion) at the top end portion of the lamp. FIG. 7 shows that the line (a) corresponding to the brightness of the lamp (a) is more even than either line (b) or line (c) corresponding to brightness of lamp (b) or the lamp (c), respectively. Further, the brightness of lamp (a) at the top end portion is much more than that of either lamp (b) or lamp (c). Since the positive column of the discharge of lamp (b) shifts to the direction of the outer electrode near the top end portion of the tube, it is observed that the brightness of lamp (b) at the top end portion decreases.

A difference in the brightness distribution between lamp (a) and lamp (c) is caused by the difference of positions of the ring shaped portion and the cap shaped portion of the outer electrode. The ring shaped portion 394 of the outer electrode 39 of the lamp (a) covers top end portion 35 in an area corresponding to the inside of the thick portion 352 of the tube 23. In other words, the ring shaped portion 394 of the outer electrode 39 of lamp (a) covers the top end portion 35 in an area corresponding to the boundary between the discharge space 25 and the inner surface, including the inner top 354 of the lump (thick portion) 352, of the top end portion 35 of the tube 23. The outer electrode of lamp (c) does not cover the top end portion 35 in an area corresponding to the boundary between the discharge space 25 and the inner surface of the top end portion 35 of the tube 23. However the brightness distribution of lamp (c) is more even near the top end portion then that of lamp (b) and the brightness of lamp (c) is much more than that of lamp (b) This occurs because lamp (c) has the ring shaped portion of the outer electrode, but lamp (b) does not have the ring shaped portion of the outer electrode.

Figure 8:
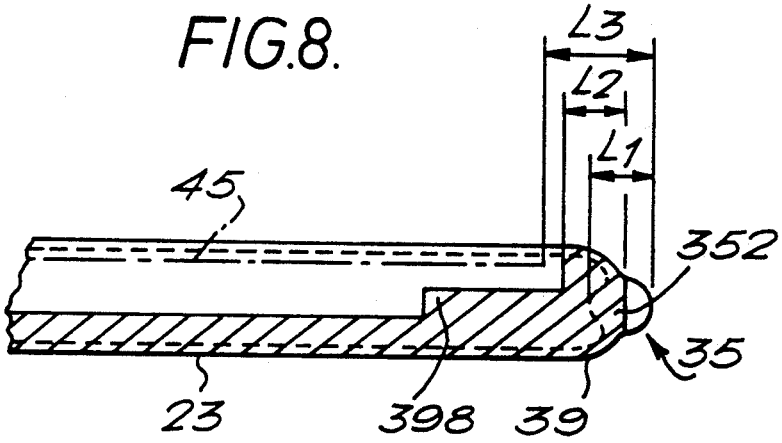
FIG. 8 is a partial side view of a low pressure gas discharge lamp without a shielding film according to a second embodiment of the present invention.
Figure 9:
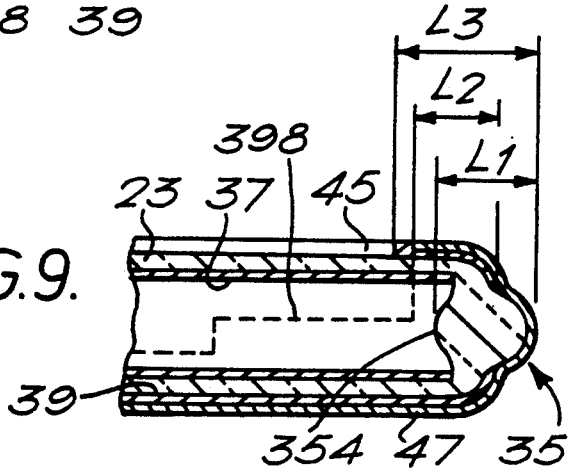
FIG. 9 is a partial sectional view of FIG. 8.

A second embodiment of the present invention, which has the outer electrode including a belt shaped portion with a wide portion 398 continuously connected to a ring shaped portion, and which is lamp (d) of FIG. 7, will be described with reference to FIG. 8 and FIG. 9, wherein the same reference numerals as those in the first embodiment denote the same or equivalent components to those in the first embodiment. The wide portion 398 of the belt shaped portion 392 of the outer electrode 39 is wider than other portions of the belt shaped portion 392 of the outer electrode 39. The outer electrode 39 has the ring shaped portion 394 the same as the first embodiment, but does not have the cap shaped portion.

The lamp of this second embodiment has the brightness distribution characteristic diagram indicated by the line (d) in FIG. 7. The feature of the outer electrode 39 of the lamp of this second embodiment is shown in lamp (d) in FIG. 7. The brightness distribution of lamp 21 of this second embodiment along the axis of the lamp 21 is more even than that of the first embodiment. The current density is likely to decrease near the top end portion 35 of the lamp 21. In order to eliminate this shortcoming, lamp 21's outer electrode 39 includes the belt shaped portion 392 with a wide portion 398. The wide portion 398 of the belt shaped portion 392 of the outer electrode 39 increases the current density within the discharge space corresponding to the wide portion 398 of the belt shaped portion 392 of the outer electrode 39. As a result, the brightness near the top end portion 35 of the lamp 21 increases and the brightness distribution of the lamp 21 of this second embodiment along the axis of the lamp 21 becomes more even.

The gas discharge lamp of the present invention is not limited to use as a display needle of an instrument. For example, the gas discharge lamp of the present invention may be used for backlighting for a liquid crystal display device, and for image reading in a copying machine, etc.

The inner electrode is not limited to the cold cathode type, but may be a hot cathode type.

The outer electrode is not limited to be formed of paste such as carbon phenol or silver epoxy. For example, an electroconductive layer as the outer electrode may be formed by vacuum evaporation, or the outer electrode may be formed of a thin metal plate attatched to the surface of the lamp.

The discharge gas of the gas discharge lamp of the present invention is not limited to xenon, but may be krypton, neon, argon, etc, or mercury as the discharge gas may be sealed in the tube of the gas discharge lamp.

In case of argon or neon as a discharge gas, a phosphor layer is not necessary, since both argon and neon emit visible light by discharge.

What is claimed is:

1. A low pressure gas discharge lamp comprising:

an elongate hollow tube having inner and outer surfaces, a tube axis and first and second end portions, said second end portion forming a thick portion which extends to an inside and an outside thereof along an axial direction of said tube and is made of the same material as that of said tube between said first end portion and said second end portion;

a filling gas contained in said tube for emitting radiation in response to a discharge;

an inner electrode disposed in said first end portion of said tube; and an outer electrode having a belt shaped portion formed on said outer surface of said tube along an axial direction of said tube between said first end portion and said second end portion of said tube and a ring shaped portion, connected to said belt shaped portion, formed on said outer surface of said tube in an area corresponding to said inner surface of said thick portion of said tube, wherein said discharge is generated between said inner electrode and said outer electrode so that a positive column of said discharge is positioned along said axis from said inner electrode to an inner surface of said thick portion and said second end portion provides sufficient illumination therethrough which is substantially equal in intensity to an illumination emitted throughout said tube.

2. A low pressure gas discharge lamp comprising:

an elongated hollow tube having first and second end portions, inner and outer surfaces and a tube axis, said tube being long enough to produce a discharge having a positive column extending along said axis, said second end portion having a wall thickness which is thicker than the wall thickness of said tube between said first end portion and said second end portion and is made of the same material as that of said tube between said first end portion and said second end portion;

a filling gas contained in said tube for emitting radiation in response to said discharge;

an inner electrode disposed in said first end portion of said tube; and an outer electrode having a belt shaped portion formed on said outer surface of said tube along an axial direction of said tube between said first end portion and said second end portion of said tube and a ring shaped portion, connected to said belt shaped portion, formed on said outer surface of said tube around said second end portion of said tube;

wherein said discharge is generated between said inner electrode and said outer electrode so that said positive column is positioned along said axis from said inner electrode to an inner surface of said second end portion and said second end portion provides sufficient illumination therethrough which is substantially equal in intensity to an illumination emitted throughout said tube.

3. A low pressure gas discharge lamp according to claim 2, further comprising a phosphor layer coated on said inner surface of said tube which is excited by said radiation and emits visible light.

4. A low pressure gas discharge lamp according to claim 2, wherein said radiation is visible light.

5. A low pressure gas discharge lamp according to claim 2, wherein said outer electrode entirely covers said second end portion.

6. A low pressure gas discharge lamp according to claim 2, further comprising a shielding member formed on the outer surface of said tube covering said outer electrode and forming a slit portion for light transmitting.

7. A low pressure gas discharge lamp according to claim 6, further comprising a phosphor layer, coated on the inner surface of said tube, which is excited by said radiation and emits visible light.

8. A low pressure gas discharge lamp according to claim 6, wherein said slit portion is formed on a portion other than a portion covered by said outer electrode.

9. A low pressure gas discharge lamp according to claim 2, wherein said belt shaped portion of said outer electrode is even width along an axis of said tube.

10. A low pressure gas discharge lamp according to claim 2, wherein said belt shaped portion has a wider portion adjacent to said ring shaped portion than at other areas of said tube.

11. A low pressure gas discharge lamp according to claim 2, wherein said filling gas is rare gas.

12. A low pressure gas discharge lamp according to claim 11, wherein said rare gas is xenon.

13. A low pressure gas discharge lamp according to claim 2, wherein said filling gas is mercury vapor.

14. A low pressure gas discharge lamp according to claim 2, wherein said second end portion forms a thick portion which extends to an outside and an inside of the tube along the axis of said tube.

15. A low pressure gas discharge lamp according to claim 14, wherein said outer electrode entirely covers said thick portion.

16. A low pressure gas discharge lamp according to claim 14, wherein said ring shaped portion of said outer electrode covers an area of the outer surface of said tube corresponding to the inner surface of said thick portion.

17. A low pressure gas discharge lamp according to claim 14, wherein said outer electrode covers said second end portion in an area corresponding to the inside of said thick portion of said tube.

* * * * *